United States Patent [19]

Otsuka et al.

[11] Patent Number: 4,990,926

[45] Date of Patent: Feb. 5, 1991

[54] MICROWAVE ANTENNA STRUCTURE

[75] Inventors: Takashi Otsuka; Junichi Kajikuri, both of Kanagawa, Japan

[73] Assignee: Sony Corporation, Tokyo, Japan

[21] Appl. No.: 258,728

[22] Filed: Oct. 17, 1988

[30] Foreign Application Priority Data

| | | | |
|---|---|---|---|
| Oct. 19, 1987 | [JP] | Japan | 62-263157 |
| Oct. 27, 1987 | [JP] | Japan | 62-270757 |
| Nov. 27, 1987 | [JP] | Japan | 62-299416 |
| Nov. 30, 1987 | [JP] | Japan | 62-301917 |

[51] Int. Cl.[5] ..... H01Q 1/38; H01Q 3/02

[52] U.S. Cl. ..... 343/700 MS; 343/878; 343/882

[58] Field of Search ..... 343/700 MS File, 769, 343/878, 880, 882

[56] References Cited

U.S. PATENT DOCUMENTS

| | | | |
|---|---|---|---|
| 4,131,894 | 12/1978 | Schiavone | 343/700 MS |
| 4,197,545 | 4/1980 | Favaloro et al. | 343/700 MS |
| 4,614,947 | 9/1986 | Rammos | 343/778 |
| 4,626,865 | 12/1986 | Rammos | 343/786 |
| 4,652,890 | 3/1987 | Crean | 343/882 |
| 4,663,635 | 5/1987 | Wu | 343/882 |
| 4,676,051 | 7/1987 | Yabu et al. | 343/700 MS |
| 4,689,634 | 8/1987 | Chymiak | 343/880 |
| 4,692,771 | 9/1987 | Rothbarth et al. | 343/882 |
| 4,726,259 | 2/1988 | Idler | 343/882 |
| 4,728,962 | 3/1988 | Kitsuda et al. | 343/700 MS |
| 4,792,810 | 12/1988 | Fukuzawa et al. | 343/700 MS |
| 4,800,394 | 1/1989 | Homann et al. | 343/882 |
| 4,827,276 | 5/1989 | Fukuzawa et al. | 343/769 |

FOREIGN PATENT DOCUMENTS

| | | | |
|---|---|---|---|
| 0071069 | 2/1983 | European Pat. Off. | 343/700 MS |
| 59-172806 | 9/1984 | Japan | 343/882 |
| 0174003 | 10/1984 | Japan | 343/878 |
| 0075103 | 4/1985 | Japan | 343/878 |

*Primary Examiner*—Michael C. Wimer
*Assistant Examiner*—Hoan Ganh Le
*Attorney, Agent, or Firm*—Hill, Van Santen, Steadman & Simpson

[57] ABSTRACT

A suspended line feed type planar antenna has a substrate sandwiched between a top plate and a bottom plate, in which a number of protrusions are formed on the top plate and the bottom plate at a plurality of corresponding positions by deforming the top plate and the bottom plate by means of a press-process or press-treatment, so that the substrate is supported by the protrusions.

13 Claims, 13 Drawing Sheets

MICROWAVE ANTENNA STRUCTURE

BACKGROUND OF THE INVENTION

The present invention relates generally to a planar array type microwave antenna for use in, receiving, for example, a satellite broadcast and more particularly to a microwave antenna structure.

In the art, a circular polarized wave planar array antenna has been previously proposed, namely, a suspended line feed type planar antenna in which a substrate is sandwiched between metal or metallized plastic plates having a number of spaced openings forming a part of radiation elements, a pair of resonance probes which are perpendicular to each other and the number of which corresponds to a number of spaced openings are formed on a common plane and signals fed to the pair of resonance probes are mixed in phase within the suspended line (in our co-pending U.S. patent applications Ser. No. 888,117 filed on July 22, 1986 and Ser. No. 058,286 filed on June 4, 1987).

It is desirable that the above-mentioned planar antenna be reduce in thickness as compared with the existing one, and also its mechanical configuration can be simplified. Further, it is desirable to use an inexpensive substrate readily available on the market for high frequency use, achieving antenna gain equal to or larger than that of the previous planar antenna which uses an expensive microstrip line substrate.

The suspended line can achieve such advantages that it forms a low loss line as a circuit for feeding the planar antenna and also that it can be formed on an inexpensive film-shaped substrate. Further, since this conventional planar antenna utilizes a circular or rectangular waveguide opening element as a radiation element it is possible to construct an array antenna which has small gain deviation over a relatively wide frequency range.

Meanwhile, a patch type microstrip line antenna element is proposed in order to reduce the thickness of the planar array antenna. Also, this patch type microstrip line antenna can be made high in efficiency, wide in band width by effective use of the advantages of the suspended line and the thin radiation element, and it can be reduced in thickness and in weight at the same time as is disclosed in our co-pending U.S. patent application Ser. No. 223,781, filed July 25, 1988.

In a suspended line feed type planar array antenna in which a substrate is sandwiched between a pair of metal or metallized plastic plates, the resonance type printed patch radiators are formed on the substrate at positions corresponding to slots formed through one of the metal or metallized plastic plates to thereby form the planar antenna.

However, in the planar array antenna disclosed in our co-pending U.S. patent application Ser. No. 233,781, a number of resonance type printed patch radiators have flanges formed therearound as supporting portion so that upon manufacturing, a cutting treatment becomes necessary. Thus, it cannot be mass-produced efficiently and also it is increased in cost.

OBJECTS AND SUMMARY OF THE INVENTION

Accordingly, it is an object of the present invention to provide an improved planar array antenna.

It is another object of the present invention to provide a planar array antenna which can be mass-produced efficiently.

It is a further object of the present invention to provide a planar array antenna which can be made at low cost.

According to an aspect of the present invention, there is provided a suspended line feed type planar antenna which comprises a substrate sandwiched between a top plate and a bottom plate, the top plate having a plurality of spaced openings defining radiation elements, a corresponding plurality of radiators formed on the substrate in alignment with the openings respectively, and feeding means for feeding the radiators, characterized in that, firstly, the top and bottom plates are each formed of a flat plate with substantially no protrusions and, secondly, protrusions are formed at a corresponding plurality of positions between the top plate and the substrate and between the bottom plate and the substrate by deforming the top and bottom plates, so that the substrate is supported by the protrusions.

According to another aspect of the present invention, there is provided a suspended line feed type planar antenna which comprises a substrate sandwiched between a top plate and a bottom plate, the top plate having a plurality of spaced openings defining radiation elements, a corresponding plurality of radiators formed on the substrate in alignment with the openings respectively, and means for feeding the radiators, characterized by an input wave-guide provided at the position of the feeding means, an output wave-guide also provided at the position of the feeding means, and supporting means having a bolt which passes through the top and bottom plates and the substrate for supporting the input and output wave-guides.

According to still another aspect of the present invention, there is provided a suspended line feed type planar antenna which comprises a substrate sandwiched between a top plate and a bottom plate, the top plate having a plurality of spaced openings defining radiation elements, a corresponding plurality of radiators formed on the substrate in alignment with the openings respectively, means for feeding the radiators, and a radome and a rear cover for enclosing the top and bottom plates, characterized in that a plurality of supporting members are formed on the inner surface of the rear cover, and a corresponding plurality of openings are formed through the top and bottom plates and the substrate at the corresponding positions of the supporting members, whereby the top and bottom plates and the substrate are held by the supporting members by means of the corresponding plurality of openings.

According to a further aspect of the present invention, there is provided a suspended line feed type planar array antenna which comprises a substrate sandwiched between a top plate and a bottom plate, the top plate having a plurality of spaced openings defining radiation elements, a corresponding plurality of radiators formed on the substrate in alignment with the openings respectively, and means for feeding the radiators, characterized by a pole having a curved top portion, a first through-hole provided at the upper side of the curved top portion and a second through-hole provided at the lower side of the curved top portion, mounting means including a first bolt passing through the first through-hole for mounting the rear cover on the pole and adjusting means including a second bolt passing through the second through-hole for adjusting the elevation-angle of the rear cover.

According to a still further aspect of the present invention, there is provided a suspended line feed type planar antenna which comprises a substrate sandwiched between a top plate and a bottom plate, the top plate having a plurality of spaced openings defining radiation elements, a corresponding plurality of radiators formed on the substrate in alignment with the openings respectively, and means for feeding the radiators, characterized by a first spacer having a corresponding plurality of spaced openings inserted between the top plate and the substrate and the bottom plate.

According to a yet further aspect of the present invention, there is provided a microwave antenna which comprises an antenna portion, a pole supporting the antenna portion, coarse adjusting means for coarse adjusting the elevation-angle of the antenna portion relative to the pole, and fine adjusting means for fine adjusting the elevation-angle of the antenna portion relative to the pole, characterized in that the fine adjusting means includes a bolt pushing the antenna portion away from the pole.

The above, and other objects, features and advantages of the present invention will become apparent from the following detailed description of the preferred embodiments, to be taken in conjunction with the accompanying drawings, throughout which like reference numerals identify like elements and parts.

Figure 11:
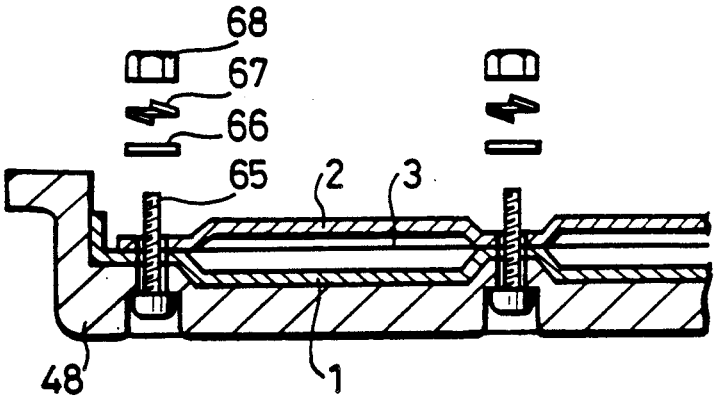
Figure 12:
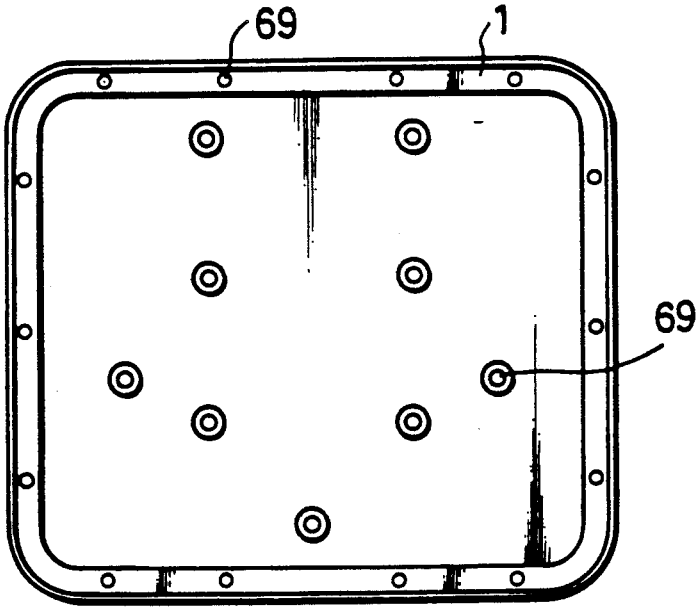
Figure 13A:
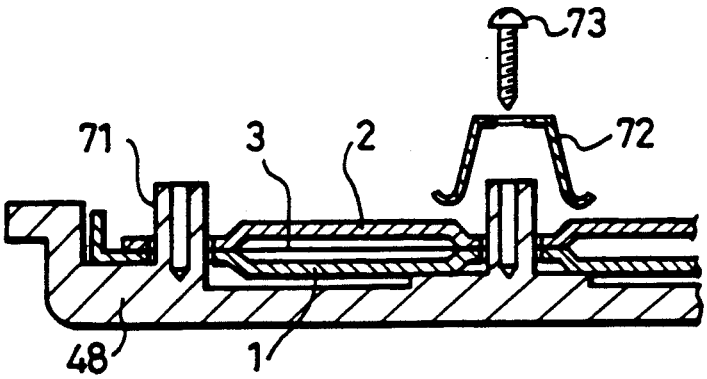
Figure 13B:
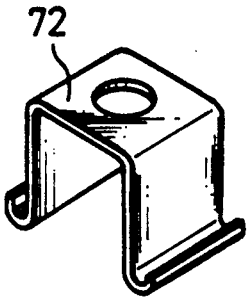
Figure 14:
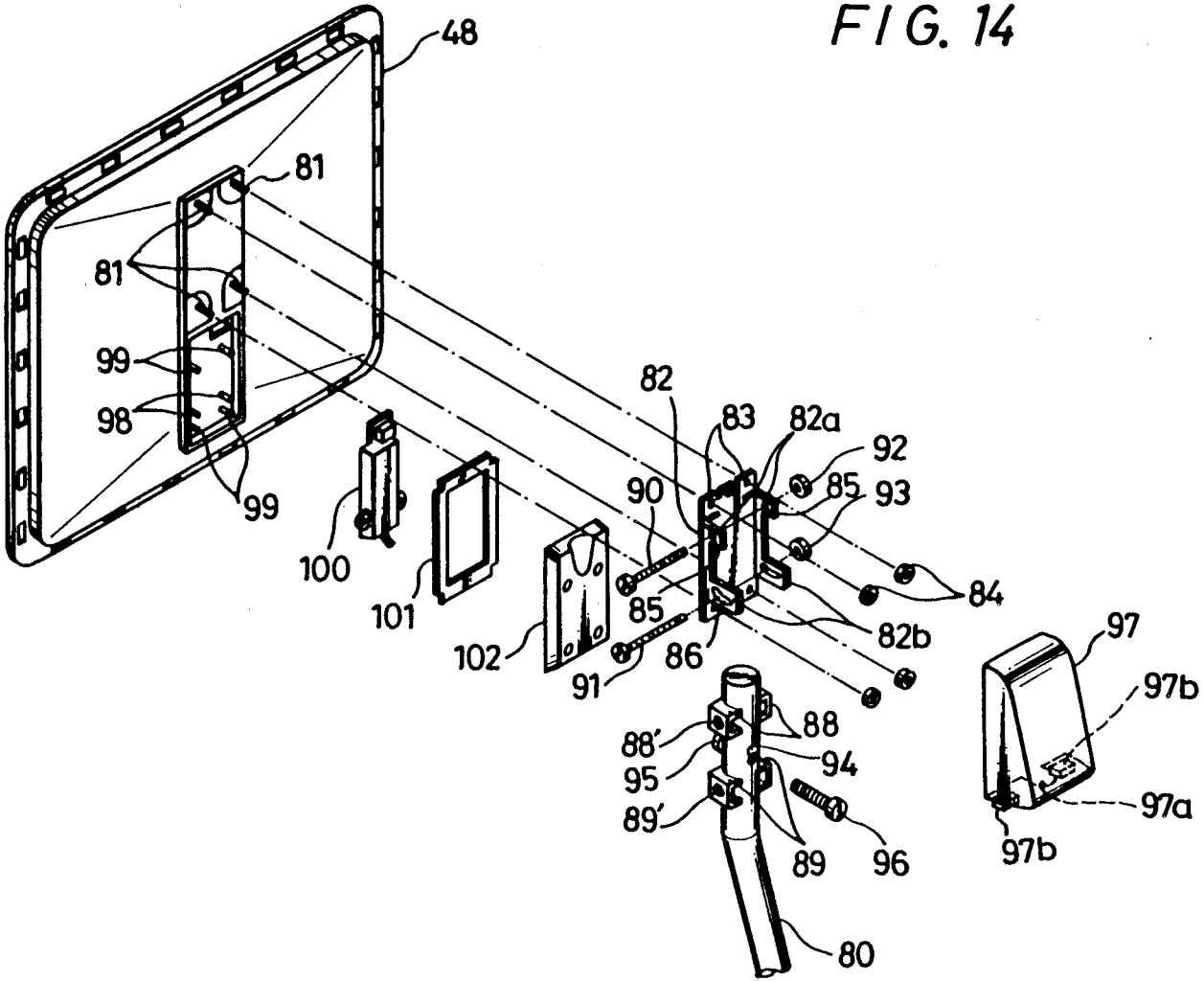
Figure 15:
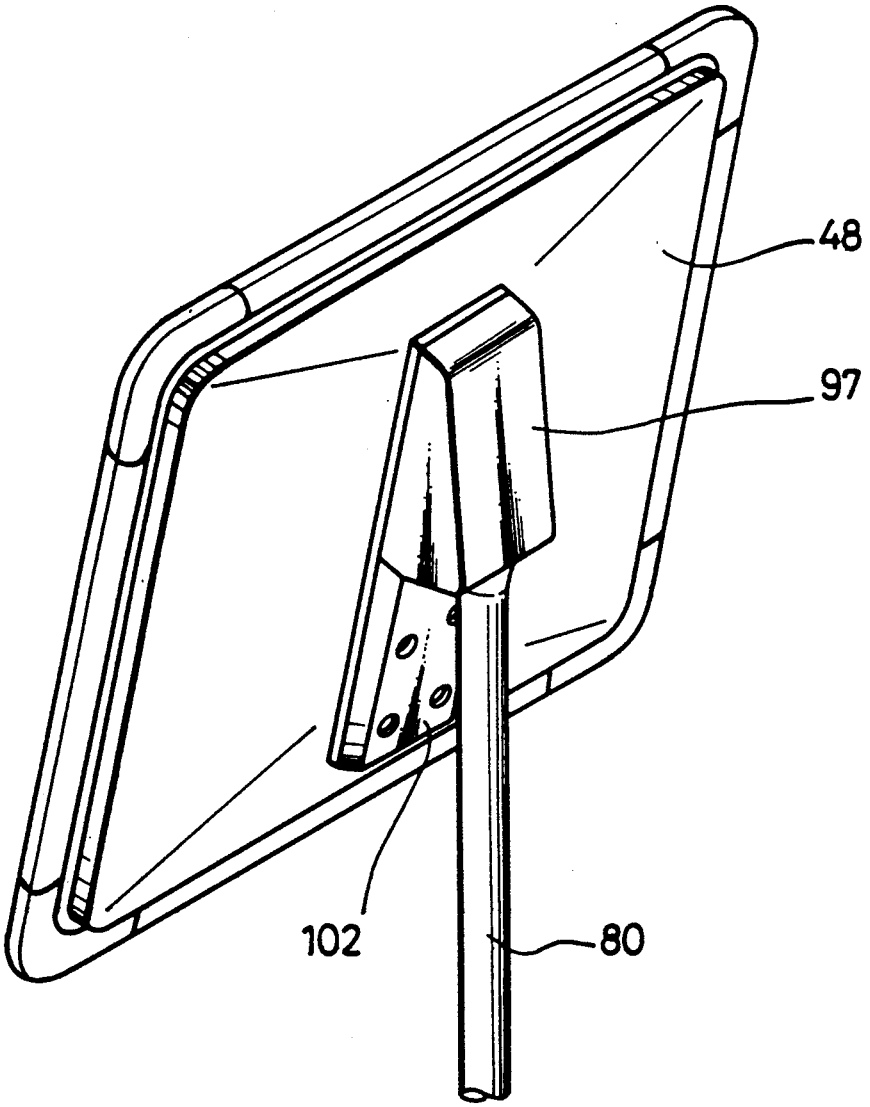
Figure 16:
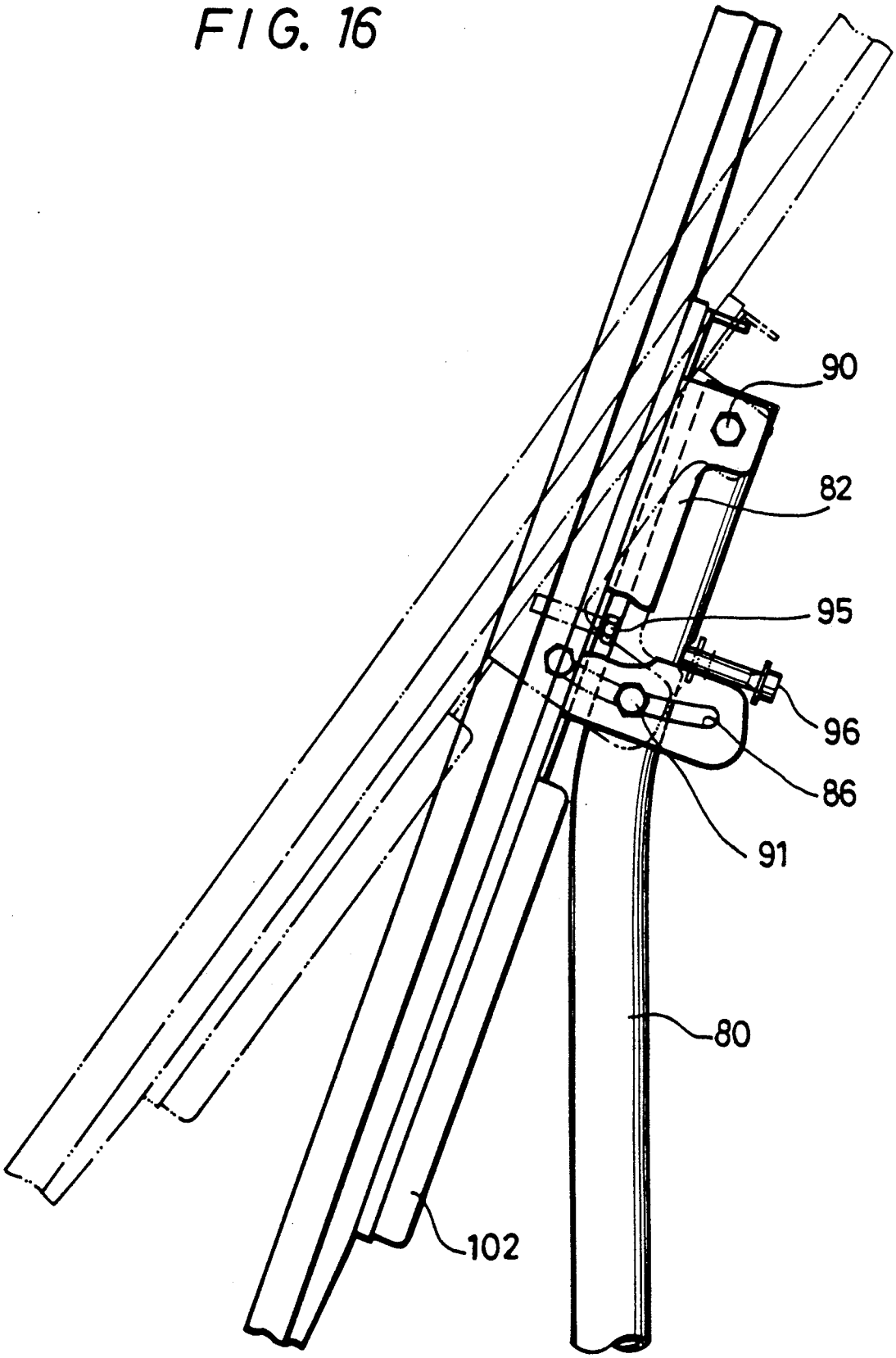
Figure 17:
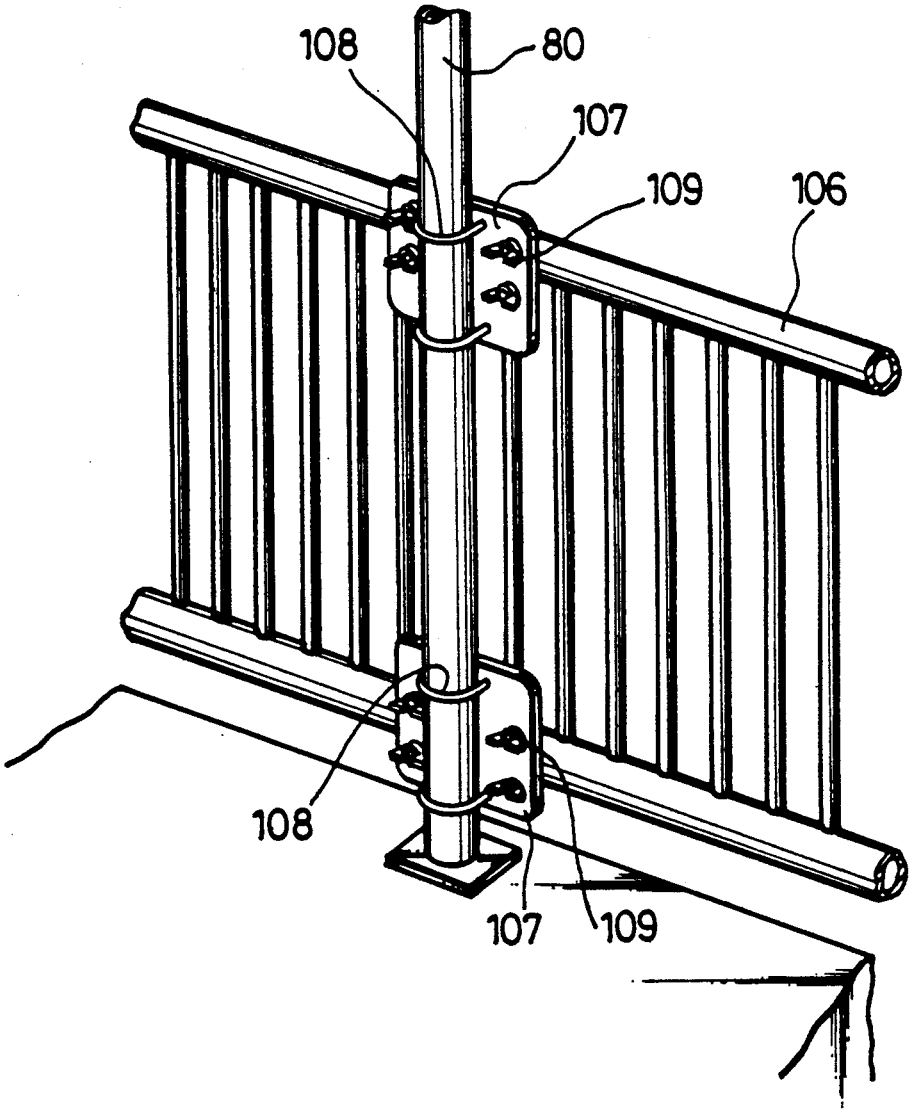
Figure 18:
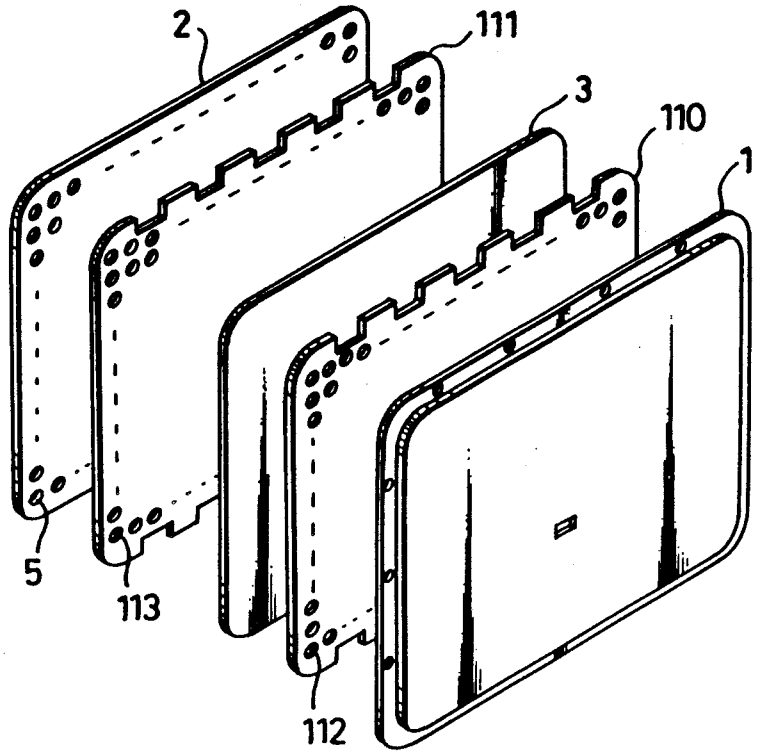
Figure 19:
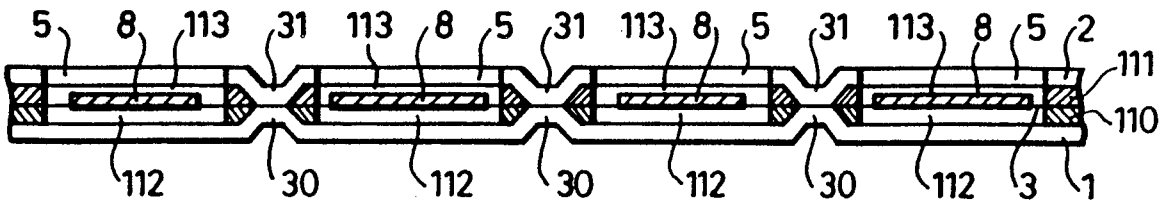
Figure 20:
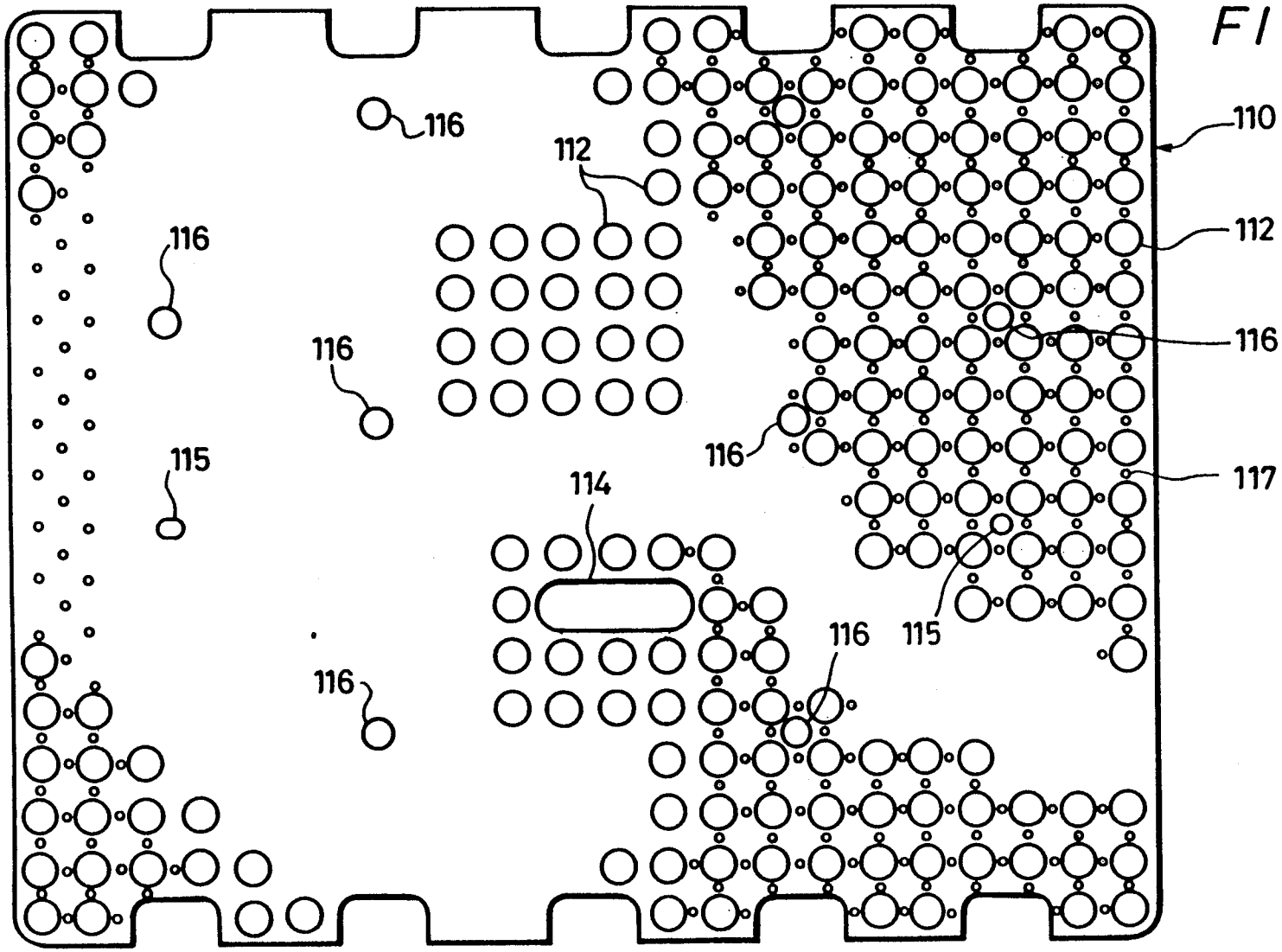

Figs. lOA and lOB are a cross-sectional view and a rear view of the overall arrangement of the antenna of the present invention, respectively;

FIG. 11 is a diagram showing a structure for mounting the main body of the antenna of the present invention to a rear cover;

FIG. 12 is a top view of an example of a bottom plate used in the antenna of the present invention;

FIGS. 13A and 13B are diagrams of another example of the structure for mounting the main body of the antenna of the present invention to the rear cover, respectively;

FIG. 14 is a diagram of an example of a structure for mounting the rear cover of the antenna of the present invention to a pole;

FIG. 15 is a diagram showing an example in which the rear cover of the antenna of the present invention is mounted on the pole;

FIG. 16 is a diagram used to explain how to adjust an elevation-angle of the antenna of the present invention;

FIG. 17 is a diagram showing an example of how to install the pole of the antenna of the present invention;

FIG. 18 is a diagram showing another example of a structure for supporting a substrate of the antenna of the present invention;

FIG. 19 is a cross-sectional view of a main portion of the antenna of the present invention shown in FIG. 18; and FIG. 20 is a plan view of the spacer shown in FIG. 18.

DETAILED DESCRIPTION OF THE PREFERRED EMBODIMENTS

Now, an embodiment of a planar array antenna according to the present invention will hereinafter be described in detail with reference to FIGS. 1 to 7.

Figure 4A:
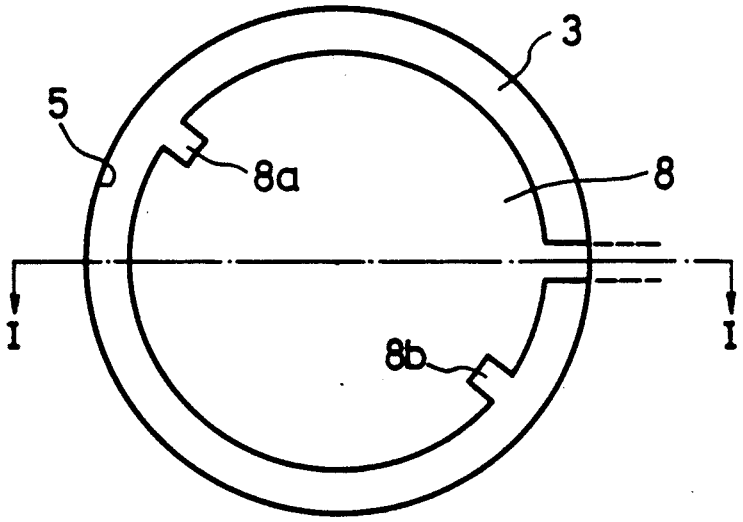
FIGS. 4A and 4B are respectively a top view and a cross-section view of a circular polarized wave radiation element used in the antenna of the present invention.
Figure 4B:
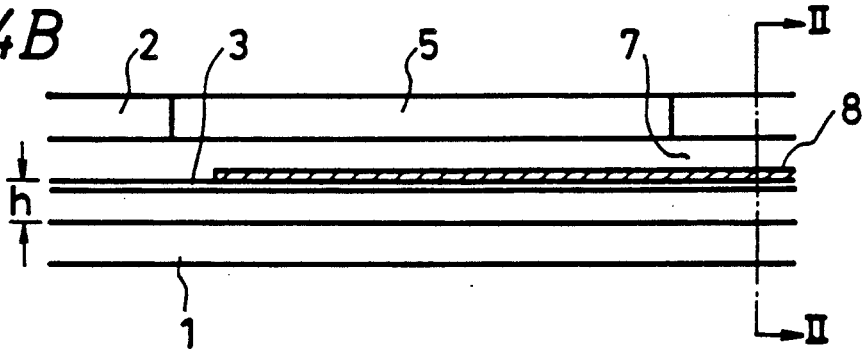

A circular polarized radiation element and a suspended-line both used in this invention will be described with reference to FIGS. 4 to 7. FIGS. 4A and 4B illustrate an arrangement of a circular polarized wave radiation element according to the present invention, wherein FIG. 4A is a top view and FIG. 4B is a cross-sectional view taken through the line I—I in FIG. 4A. In FIGS. 4A and 4B, reference number 1 designates a lower plate or a first metal plate (or metallized plastic plate), 2 an upper plate or a second metal (or metallized plastic plate) and 3 a substrate made of a thin film (film-shaped flexible substrate) sandwiched between the first and second metal plates 1 and 2. The first metal plate 1 has a convex-shaped protrusion 30 (see Figs. 1 and 2) for supporting the substrate 3 thereon. The second metal plate 2 has an opening of, for example, a circular opening of 14 mm in diameter, as shown in FIG. 4A, i.e., a so-called slot 5 and a convex-shaped protrusion 31 (see FIG. 2) formed at its position near the slot 5 for supporting the substrate 3. When the first and second metal plates 1 and 2 sandwich the substrate 3 therebetween, the first and second metal plates 1 and 2 are positioned such that their supporting portions 30 and 31 coincide and lie opposite each other. The thickness of each of the first and second metal plates 1 and 2 at that time is reduced very much and it becomes, for example, about 2 mm. Further there is formed a cavity portion 7 that communicates with the slot 5 when the substrate 3 is sandwiched between the first and second metal plates 1 and 2.

A conductive foil 8 is deposited on the substrate 3 so as to correspond to and be concentric with the slot 5 of the second metal plate 2, as shown in FIG. 4A, and to form a so-called resonance type printed patch radiator. This conductive foil 8 is coupled through the cavity portion 7 to form a suspended line. In this case, the conductive foil 8 of the substantially circular-shape is arranged to have such a diameter that it can resonate at a predetermined frequency. The conductive foil 8 is provided with slits **8*a* and 8*b* (FIG. 4*a*) diametrically opposed to each other at angular positions relative to the direction of the suspended line by a predetermined angle, for example, 45° in order to receive and transmit a circular polarized wave. As shown in FIG. 4A, the left slit 8*a* is positioned at −45° from the horizontal and the slit 8*b* is positioned at +45° from the horizontal. In this embodiment, when transmitting or receiving microwaves on the surface of the sheet of drawing, the antenna of the invention can transmit or receive a clockwise circular polarized wave. To transmit or receive a counter-clockwise circular polarized wave, the slits 8***a* and 8*b* have to be formed on the conductive foil 8 at 45° relative to the direction suspended line, and on the opposite side to those for the clockwise circular polarized wave, viz, with slits 8*a* and 8*b* position at +45° and −45°, respectively.

Figure 5:
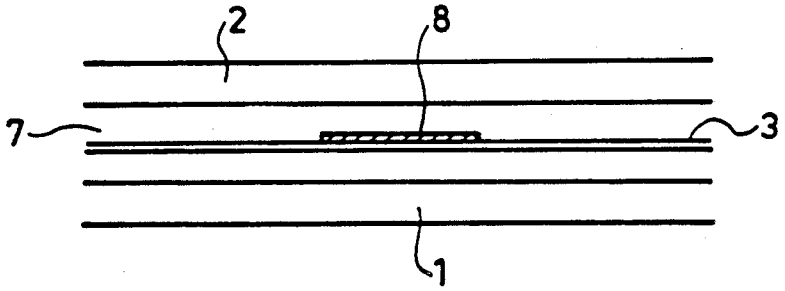
FIG. 5 is a cross-sectional view of a suspended line used in the antenna of the present invention.

The structure of the suspended line for feeding the planar array is illustrated in FIG. 5, which is a cross-sectional view taken through the line II—II in FIG. 4B. In this embodiment, the conductive foil 8 is formed by etching, i.e., removing the unwanted foil portions, a conductive film coated on the substrate 3 of, for example, 25 to 100 μm thick. The suspended line 8 is surrounded by the first and second metal plates 1 and 2 to form a hollow-shaped coaxial line. In this case, since the substrate 3 is thin and acts only as the supporting member, it forms a feeding line which has a small transmission loss, even though it is not a low loss substrate. While the transmission loss of an open strip line made of, for example, Teflon (registered trademark) glass substrate falls in a range of 4 to 6 dB/m at 12 GHz, the suspended line of the present invention, made of a film-shaped substrate of 25 μm thick, has a transmission loss in the range of about 2.5 to 3 dB/m at 12 GHz. Since the film-shaped flexible substrate is inexpensive as compared with the Teflon glass substrate, the former can bring about many advantages also from a structure (characteristic) standpoint.

Figure 6:
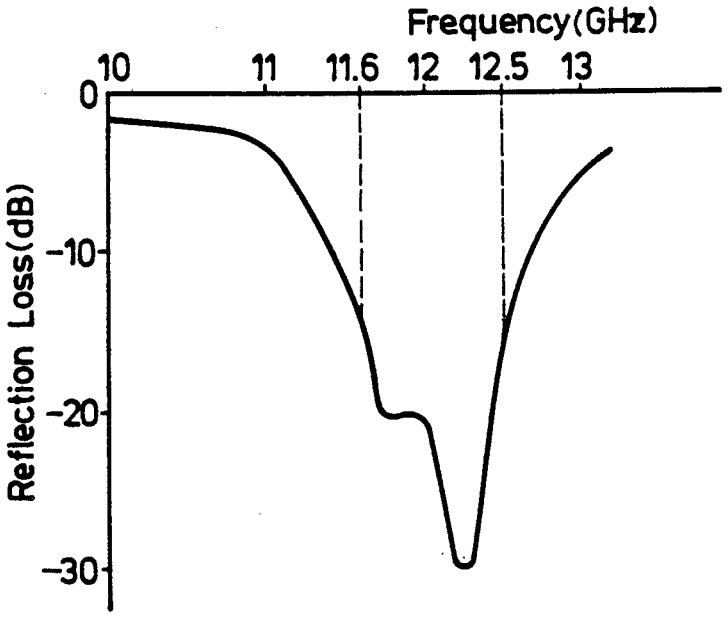
FIGS. 6 and 7 are respectively characteristic graphs of the circular polarized wave radiation device used in the antenna of the present invention.

FIG. 6 illustrates the loss vs. frequency characteristic of the circular polarized radiation element of the present invention. From FIG. 6, it is thus apparent that this circular polarized radiation element of the invention has an excellent minimum return loss of −30 dB in the 12 GHz band and that the single element has return loss less than −14 dB (voltage standing wave ratio, VSWR < 1.5) over a bandwidth of about 900 MHz, thus bringing about a relatively wide gain. The reason for this is that while the height h from the surface of the first metal plate 1 to the surface of the substrate 3 (refer to FIG. 4) is about 1 mm, the equivalent relative dielectric constant $\epsilon$ is a function of the relative dielectric constant of the air between the first metal plate 1 and the substrate 3, and the relative dielectric constant of the substrate 3 can be selected to be as small as about 1.05.

Figure 7:
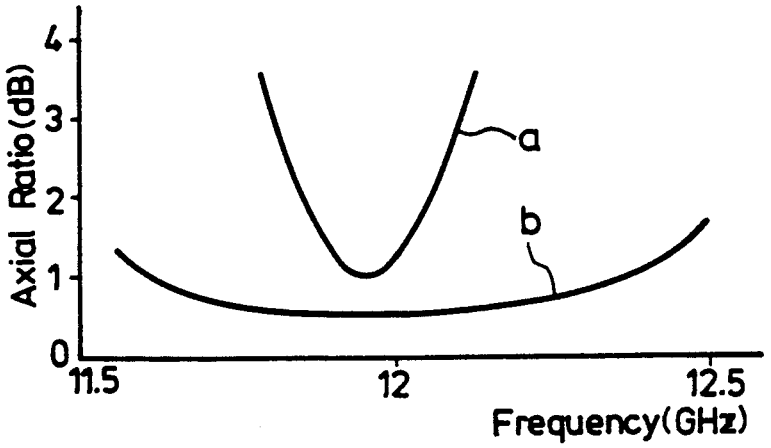

FIG. 7 illustrates an example of the measured axial ration of the circular polarized wave in the present invention. In FIG. 7, a curve a indicates a measured axial ratio where the antenna of the invention has a single circular polarized radiation element, and a curve b indicates a measured axial ratio where the antenna of the invention has four circular polarized radiation elements. The tolerance range is about 1 dB at frequency of 12 GHz, and as shown in FIG. 7, the circular patch-slot planar array antenna of the present invention sufficiently satisfies this tolerance range.

Figure 1:
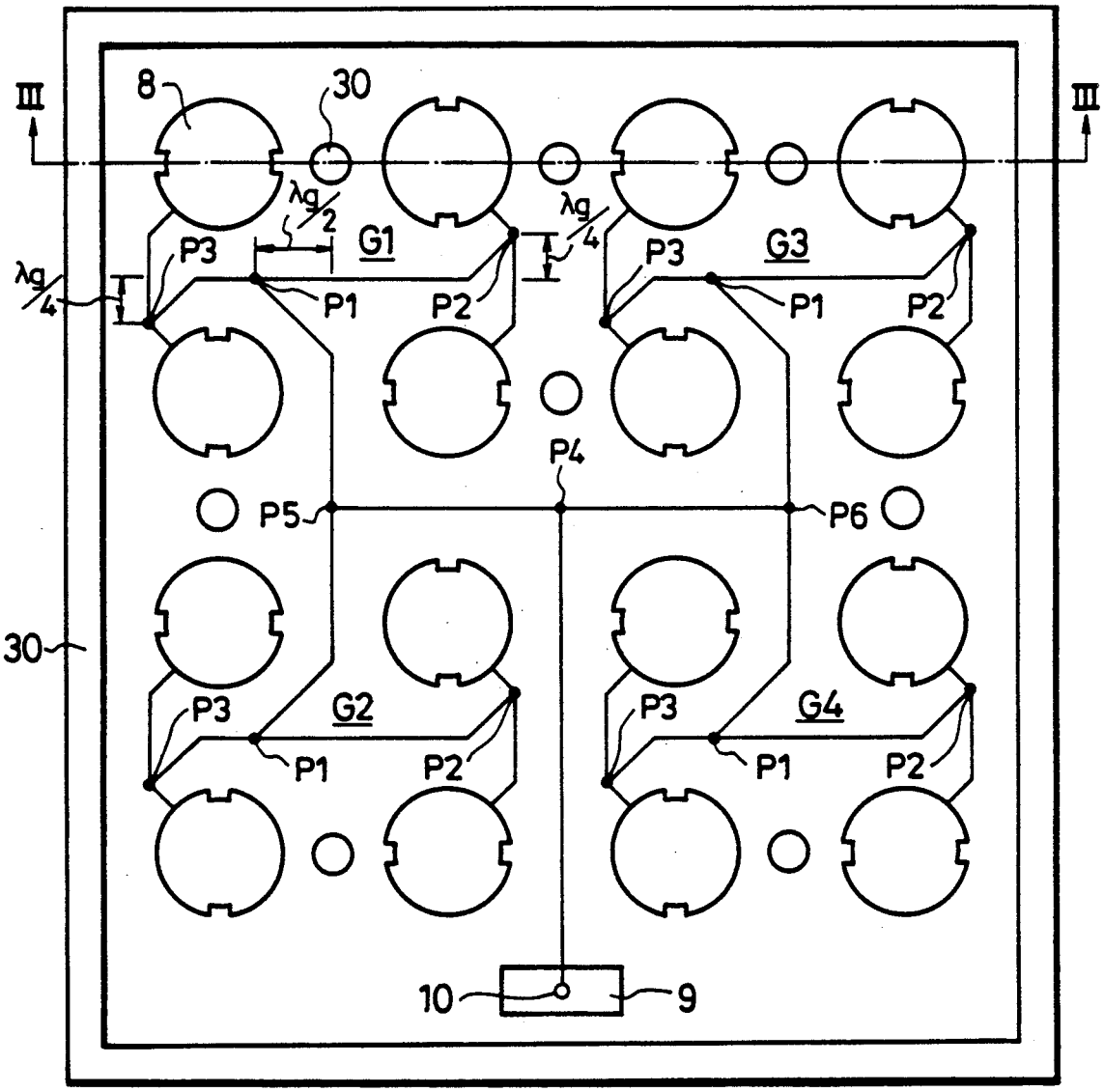
FIG. 1 is a top view of a main portion of an embodiment of an antenna according to the present invention.
Figure 2:
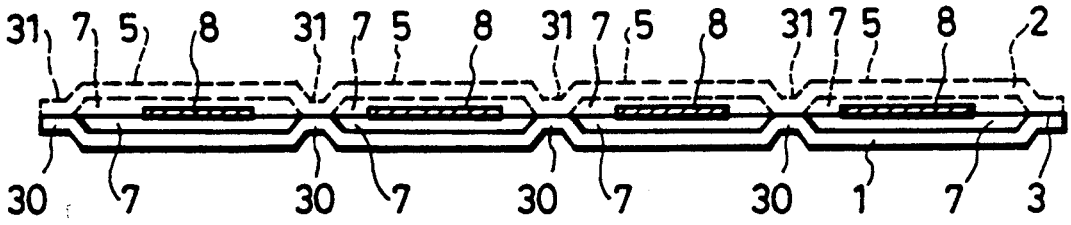
FIG. 2 is a cross-sectional view taken through the line III—III in FIG. 1.

FIG. 1 illustrates a circuit arrangement of a co-phase feeding circuit in which a plurality of the circular polarized radiation elements shown in FIGS. 4A and 4B are provided, and the suspended line is used to effect the co-phase feeding, thus forming a planar array antenna. The solid-line portion in FIG. 2 illustrates a portion cut through the line III—III in FIG. 1. The broken line portion of FIG. 2 illustrates the second metal plate 2 (not shown in FIG. 1), which covers the top of the apparatus of FIG. 1.

As FIGS. 1 and 2 show, a plurality of the protrusions 30 are formed on the first metal plate 1 between the conductive foils 8 and the suspended lines, in order to support the substrate 3. The protrusion 30 is further provided on the first metal plate 1 around the outer peripheral portion of the planar array antenna , as shown. Other portions of the first metal plate 1 form the cavity portions 7. Therefore, there is a risk that the outputs from the plurality of conductive foils 8 may be delivered through the same cavity portion 7 and hence the above-mentioned outputs will be coupled with each other. If, however, the spacing between the neighboring conductive foils 8 and the spacing between the upper and lower walls of the cavity portion 7 are properly selected, necessary isolation can be established, thus eliminating the above-mentioned risk of the mutual coupling. Since the electric lines of force are concentrated on the upper and lower walls of each cavity portion 7, the electric field along the substrate 3 supporting the conductive foil 8 is substantially removed, thus lowering the dielectric loss. As a result, the transmission loss of the line is reduced.

The protrusions 31 and the cavity portions 7 are also formed on the second metal plate 2 in correspondence with those of the first metal plate 1. Specifically, the protrusion 31 are formed on the second metal plate 2 around the slots 5, and around the periphery of the feeding portion positions between the conductive foils 8 and the suspended lines to support the substrate 3, while other portions between the protrusions form the cavity portions 7 (see FIG. 2).

Since the substrate 3 is uniformly supported by the protrusions 30, 31 provided as described above, it can be prevented from being warped downwardly. In addition, since the top and bottom metal plates 1 and 2 are brought in face-to-face contact with the substrate 3 around the respective radiation elements, the feeding portions and so on, similarly to the prior art, it is possible to prevent any resonance at a particular frequency and so on from being caused.

Referring to FIG. 1, 16 radiation elements are arranged in groups of four, to provide 4 radiation element groups G1 to G4. A junction P1 in the suspended line seeking each group is displaced from the center point of the group by a length of $\lambda g/2$ ($\lambda g$ represents the line wavelength at the center frequency). Junctions P2 and P3 in the suspended lines feeding two radiation elements in each group are connected with a displacement of each of $\lambda g/4$ from the center point between these two. Accordingly, in each group of the radiation elements, the lower-right-hand radiation element is displaced in phase from the upper-right-hand radiation element by 90°, the lower-left-hand radiation element is displaced therefrom by 180° and the upper-left-hand radiation element is displaced therefrom by 270°, respectively, which results in the axial ratio being improved. In other words, the axial ratio can be improved to be wide by varying the spatial phase and the phase of the feeding line. In view of another aspect, any two of vertically or horizontally neighboring patch radiators have slit directions 90° apart from each other.

The junction P1 in each group and the junctions P4 to P6 in the suspended lines feeding the respective groups are coupled to one another in such a fashion that they are distant from the feeding point 10 of a feeding portion 9 by an equal distance.

With the above-mentioned arrangement, it is possible to obtain various kinds of directivity characteristics, by changing the feeding phase and the power distribution ratio, by changing the positions of the junction P1 and the junctions P4 to P6. In other words, the feeding phase is changed by varying the distances from the feeding point 10 to the junctions Pl, and to the junctions P4 to P6, and the amplitude is varied by varying the impedance ration by increasing or decreasing the thickness of the lines forming the various branches of the suspended line, whereby the directivity characteristics can be varied in a wide variety.

Figure 3A:
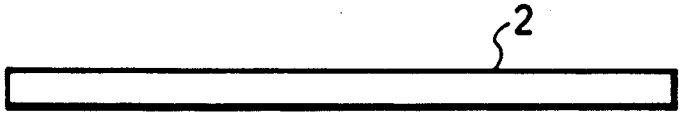
FIGS. 3A, 3B and 3C are respectively diagrams used to explain the press-treatment of top and/or bottom plate of the antenna of the present invention.
Figure 3B:
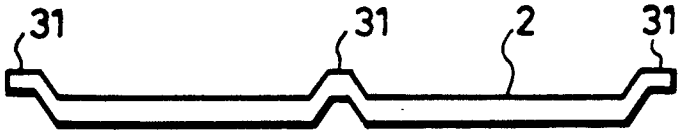
Figure 3C:
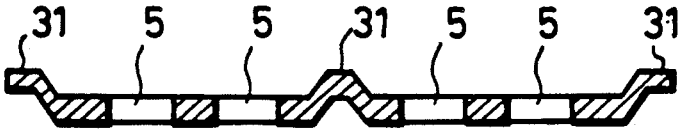

FIG. 3 illustrates a process in which the protrusions 31 and the slots 5 are formed on the second metal plate 2, for example, by a press-process or press-treatment, wherein the flat metal plate 2 is prepared as shown in FIG. 3A, the protrusion 31 is formed through the press-treatment (drawing-treatment) using a metal mold (not shown) as shown in FIG. 3B, and the slot 5 is formed by the press-treatment (punch-out process) as shown in FIG. 3C. In the case of the first metal plate 1, though not shown, the process of FIG. 3B, that is, the process for forming the protrusion 30 may be sufficient.

In this embodiment as described above, the protrusions 30 and 31 for supporting the substrate 3 are formed by the simple press-process and a cutting-treatment is not necessary, so that the antenna of the invention can be mass-produced at high efficiency and at a low cast. In the prior art, the supporting portion just like the flange has to be positioned around the slots 5 for the radiation elements with high accuracy. Unlike the prior art, the protrusions 30 and 31 of this embodiment do not require high accuracy in manufacturing process so long as they are spaced from and thus do not hinder the conductive foil 8 which forms the radiation element and the suspended line.

Further, according to the embodiment of the present invention, as set forth above, since the thickness of the radiation element (substantially the sum of the thicknesses of the first and second metal plates 1 and 2) becomes about 4 mm, the antenna made of metal according to the invention weighs about 1.1 kg (a square of 40 cm×40 cm) or the antenna made of metallized plastic material according to the invention weighs 0.3 to 0.5 kg (also a square of 40 cm×40 cm), thus the antenna of the present invention being reduced both in weight and thickness. Furthermore, since both the first and second metal plates used to form the antenna of the present invention are very thin, the antenna made of metal can be manufactured by the press-treatment and can be mass-produced efficiently. Being light-weight and reduced in thickness, the antenna of the invention can be produced at low cost and can be made attractive as a product from a marketability standpoint. Since the equivalent relative dielectric constant $\epsilon$ of the present invention can be reduced to 1.5, high antenna gain over a wide bandwidth can be achieved.

Further, since the suspended line is employed as a feeding line, the opening 5 bored through the second metal plate 2 is formed as a slot and the diameter of this slot is selected to be as small as about 14 mm. the distance between the adjacent radiation elements can be made wide with the result that the width of the feeding line can be increased, thus reducing the transmission loss in the line. In addition, since antenna gain over a wide bandwidth can be obtained, and the transmission loss can be lowered, the gain (efficiency) of the antenna can be improved.

While the radiation element is mainly described in the aforesaid embodiment, it is needless to say that owing to reciprocity theorem of the antenna, the radiation element (or antenna formed of radiation element array) can act as a receiving element (reception antenna) without any change in its characteristics.

While a circular resonance type printed radiator is described in the above-mentioned embodiment, the shape of the resonance type printed radiator is not limited to the above but it can take other desired shapes.

While the antenna of this embodiment is used for the frequency band of 12 GHz, it can be similarly applied to other frequency bands by varying the size of the radiation element.

According to the present invention as described above, since the protrusions are formed on the first and second or top and bottom plates at their corresponding positions by the press-treatment, and the substrate is supported by these protrusions the antenna of the present invention can be mass-produced more efficiently and the manufacturing cost thereof can be reduced.

Figure 8B:
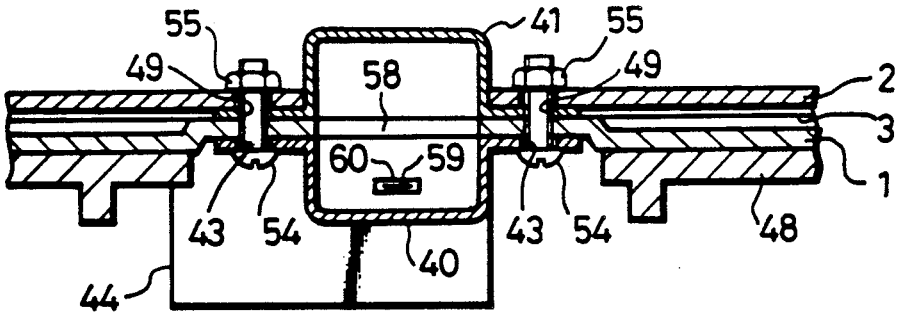
FIGS. 8A to 8C are respectively diagrams showing a structure of the peripheral portion of the feeding portion of the antenna of the present invention.
Figure 8A:
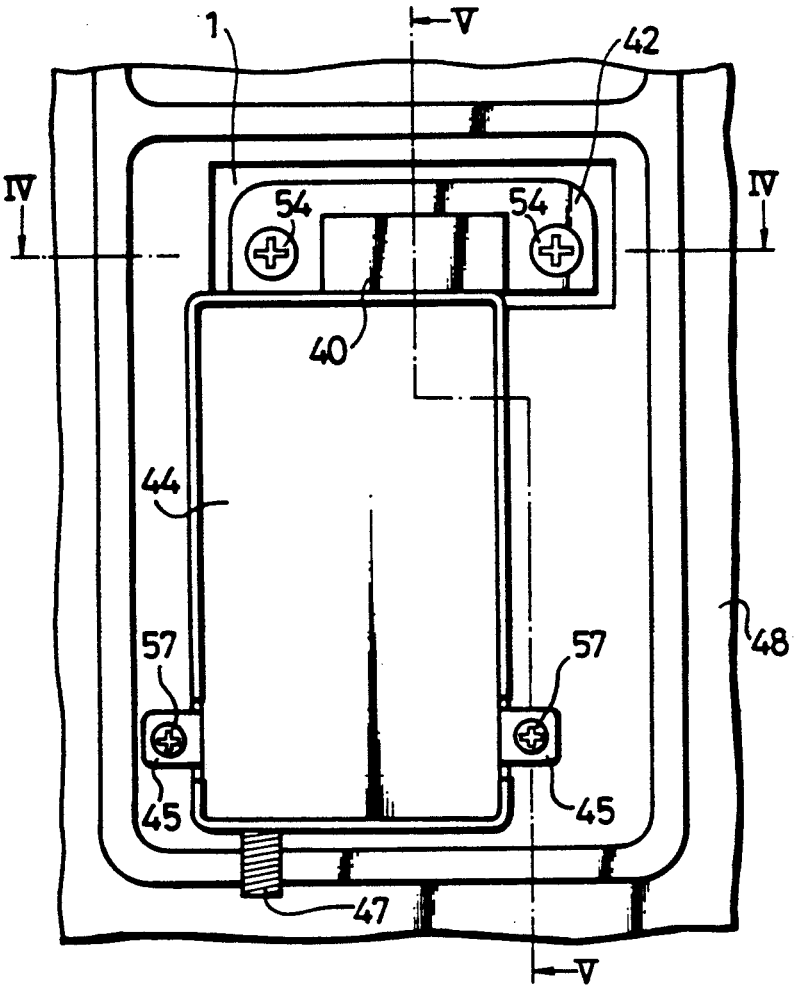
Figure 8C:
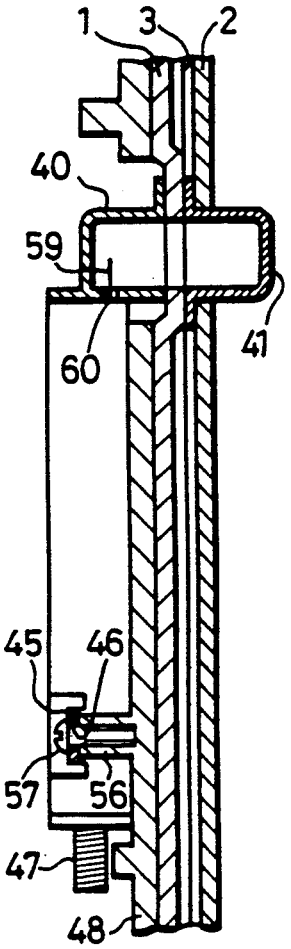

While the feeding portion 9 is formed at the peripheral portion of the main body of the antenna in FIG. 1, the structure of the feeding portion 9 is as shown in FIGS. 8A to 8C, in practice. FIG. 8A is its rear view, FIG. 8B is a cross-sectional view taken through the line IV—IV in FIG. 8A and FIG. 8C is a cross sectional view taken along the line V—V in FIG. 8A.

Referring to FIGS. 8A and 8B, there are shown an input wave-guide 40 and an output wave-guide 41, respectively. The input wave-guide 40 has a flange 42 formed therearound, and the flange 42 has a plurality of mounting screw bores 43 bored therethrough. The input wave-guide 40 is mounted on the top portion of a converter 44 by, for example, soldering or the like. The converter 44 has flanges 45 on both sides which are extended therefrom in the lateral direction in FIG. *8a*. and these flanges 45 have mounting screw bores 46 bored therethrough, respectively. Also, the converter 44 has an output connector 47 mounted on the side wall of its lower portion to be connected with a cable (not shown). The converter 44 has a rear cover 48 extended therefrom toward the lower side and the peripheries thereof.

Figure 9:
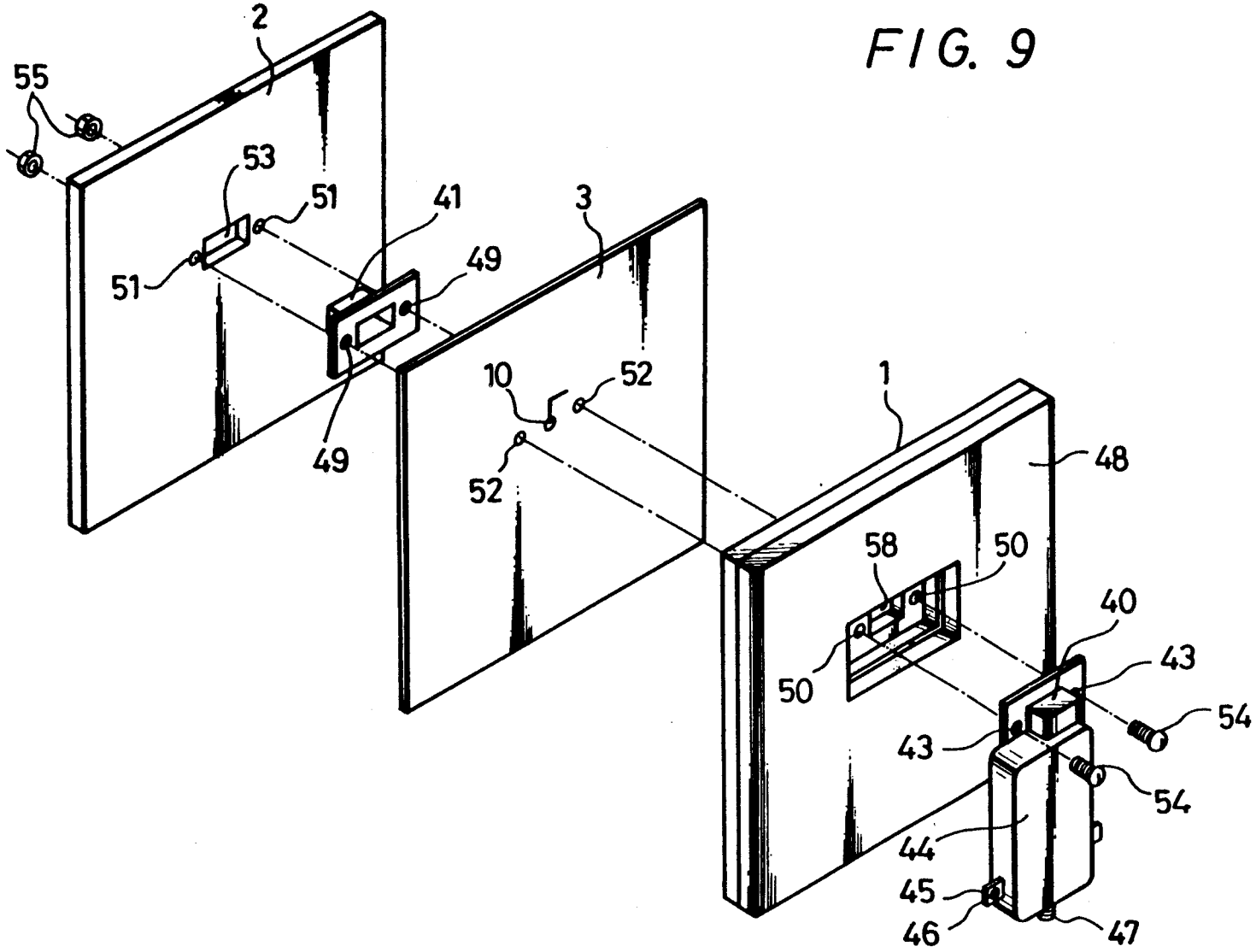
FIG. 9 is a diagram showing an assembly process of the peripheral portion of the feeding portion of the antenna of the present invention.
Figure 10B:
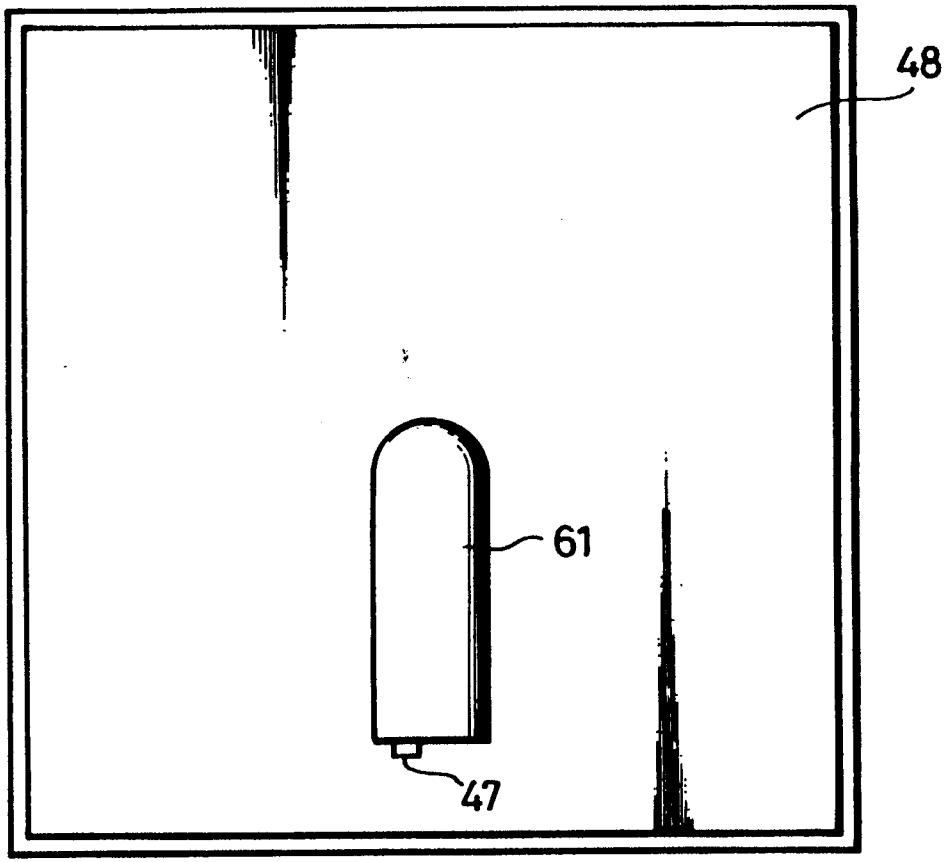
Figure 10A:
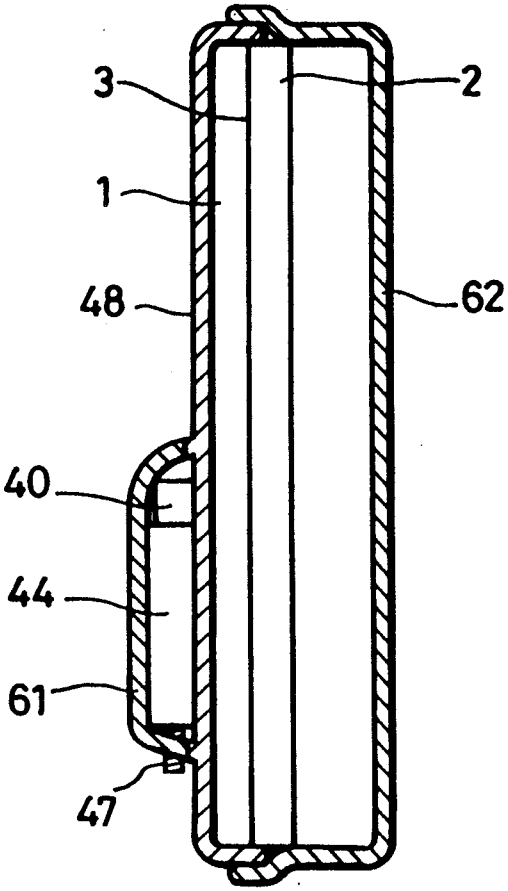

A shown in FIG. 9, the output wave-guide 41 has mounting screw bores 49 bored through its flange at the positions corresponding to the screw bores 43 of the input wave-guide 40. In like a manner the metal plates 1 and 2 and the substrate 3 each have a plurality of bores 50, 51 and 52, respectively. Then, the projected portion of the output wave-guide 41 is pushed into an opening 53 bored through the second metal plate 2. Thereafter, the output wave-guide 41 is opposed to the input wave-guide 40, screws 54 are inserted into the screw bores 43, 50, 52, 49 and 51 and then their protruded end are respectively engaged with self-locking nuts 55, thus mounting the input and output wave-guides 40, 41 as one body together with the metal plates 1, 2 and the substrate 3.

The converter 44 is, after its flanges 45 are respectively made coincident with bosses 56 formed on the rear cover 48 (refer to FIG. 8C), secured to the rear cover 48 by screws 57. Also, the first metal plate 1 has an opening 58 formed therethrough such that the input and output wave-guides 40 and 41 can be communicated with each other through the opening 58. The input wave-guide 40 has an opening 60 bored through its side wall so that a conversion probe 59 connected with a circuit (not shown) provided inside the converter 44 may be projected therethrough into the inside of the input wave-guide 40.

As will be clear from FIGS. 8A to 8C, the rear cover 48 has a stepped-up or protruded portion around the periphery of the converter 44, and a cover 61 (see Figs. 1OA and 1OB) for the converter 44 is mounted on the above portion independently of the rear cover 48.

The assembly step of the antenna of the invention will be described with reference to FIG. 9 forming an exploded perspective view.

Referring to FIG. 9, the self-locking nuts 55 are respectively embedded and then secured on the second metal plate 2 so as to coincide with the screw bores 51 bored through the second metal plate 2. Then, the projected portion of the output wave-guide 41 is pushed into the opening 53 of the second metal plate 2. At that time, the screw bores 49 bored through the flange of the output wave-guide 41 at its both sides are respectively made coincident with the screw bores 51 of the second metal plate 2.

Then, the first metal plate 1 is placed on the rear cover 48 and the substrate 3 is pinched by the first and second metal plates 1 and 2. At that time, the screw bores 49, 52 and 50 are made coincident with one another. The screw bores 43 of the input wave-guide 40 fixed to the converter 44 are respectively made coincident with the screw bores 50 of the first metal plate 1 which are seen from the cut-away portion of the rear cover 48. The screws 54 are then inserted into the screw bores 43, 50, 52, 49 and 51, engaged with the self-locking nuts 55 and then fastened so that the input and output wave-guides 40, 41 are mounted as one body together with the metal plates 1, 2 and the substrate 3. When they are mounted as on body thereon, the feeding point 10 of the feed portion of the substrate 3 is opposed to the input and output wave-guides 40 and 41.

Figs. 1OA and 1OB illustrate an arrangement in which the rear cover 48 and a radome 62 are mounted on the planar array antenna with the converter 44. FIG. 1OA is a cross-sectional side view and FIG. 1OB a rear view thereof. The rear cover 48 is made of a plastic material such as a reinforced plastic material or the like having an excellent weather-proof property, and the radome 62 is made of a plastic material which hardly attenuates, for example, a high frequency signal and which has an excellent weather-proof property. Between the second metal plate 2 and the radome 62 of the planar array antenna, there is formed a spacing of a predetermined size to reduce the reflection loss.

According to the embodiment as described above, even though the thickness of the first and second metal plates 1 and 2 forming the antenna are thin, the input and output wave-guides 40 and 41 can be secured as one body by using the screws 54 easily and positively. Further, since the self-locking nuts 55 are substantially embedded or fixed to the second metal plate 2 in advance, the input and output wave-guides 40, 41 can be easily formed as one body, together with the first and second metal plates 1, 2 and the substrate 3, only by screwing the screws 54 into the nuts 55.

FIG. 11 shows an example of a structure by which the main body of antenna is fixed to the rear cover 48.

Referring to FIG. 11, the rear cover 48 has a plurality of bolts 65 with bolt head portions embedded therein at predetermined positions in advance. The bolts 65 are sequentially engaged with the bottom plate 1, the substrate 3 and the top plate 2 forming the main body of antenna, and then the protruded end portions of the bolts 65 are engaged with plain washers 66 and spring washers 67. Thereafter they are fastened by nuts 68. It is needless to say that the bottom plate 1, the substrate 3 and the top plate 2 have openings bored therethrough to be engaged with the plurality of bolts 65 in advance.

The number of bolts 65 is pre-determined, for example, 23 so that as typically shown in FIG. 12, the bottom plate 1 has 23 openings 69 bored therethrough in correspondence with the number of bolts 65. Of course, the substrate 3 and the top plate 2 have similar openings bored therethrough.

FIGS. 13A and 13B shown another example of a structure which enables the main body of antenna to be mounted on the rear cover 48.

In this example, as shown in FIG. 13A, the rear cover 48 has a plurality of bosses 71 integrally formed thereon. The number of the bosses 71 is, for example, 23, similarly as described above. Accordingly, the bottom plate 1, the substrate 3 and the top plate 2 forming the main body of antenna have a plurality of openings formed therethrough at their positions corresponding to these bosses 71.

Upon assembly, the bosses 71 of the rear cover 48 are respectively engaged into the openings of the bottom plate 1, the substrate 3 and the bottom plate 2 forming the main body of antenna with the result that these bosses 71 are projected from the main body of the antenna. In order to fix the main body of the antenna to the rear cover 48, a plate holder 2 made of, for example, spring stainless steel as shown in FIG. 13B is employed and placed on each of the bosses 71. A tapping screw 73 is inserted into the boss 71 from above the plate holder 72 and then fastened together, thus the main body of antenna being secured to the rear cover 48. The plate holder 72 may be a holder made of a plastic material which is press-inserted into the boss 71. If the plate holder 72 is made of a plastic material, the plastic material is not a conductive material so that directivity of the antenna can be fully protected from being influence by the holder 72.

Then, the radome 62 encloses the rear cover 48 incorporating the main body of antenna, thus completing the planar array antenna (see FIG. 1OA).

In the example shown in FIG. 13A, since instead of the bolts 65 being embedded in the rear cover 48, the bosses 71 are formed on the rear cover 48, it is possible to increase the production efficiency of the rear cover 48. Further, since in place of the nuts, the washers and so on, the tapping screws 73 are used, the workability of the assembly steps can be improved. Furthermore, since the height of the boss 71 is made high enough, using the plate holder 72, the use of the tapping screw 73 becomes possible, thus reducing the number of assembly parts. In addition, the self tapping screw may have a Phillips type socket head, so that the production efficiency on the production line can be increased.

FIG.14 is an exploded perspective view of a structure by which the rear cover 48 is secured on a pole 80.

Referring to FIG. 14, the rear cover 48 has a number of bolts 81 embedded in advance into its rear wall. These bolts 81 are engaged with openings 83 of a movable pedestal 82 and fastened by nuts 84, thus securing the movable pedestal 82 to the rear cover 48. The movable pedestal 82 has a pair of projected portions 82*a* projected rearwards from its upper portion and a pair of projected portions 82*b* projected rearwards from it slower portion which are slightly larger than the former. The projected portions 82*a* respectively have openings 85 bored therethrough and the projected portions 82*b* respectively have slots 86 formed therethrough. The pole 80 to which the moving pedestal 82 is attached has a pair of pole supporting members 88 and 89 formed thereon at its positions corresponding to the projected portions 82*a* and 82*b* of the movable pedestal 82. These supporting members 88 and 89 have through-holes 88' and 89' bored therethrough and also through the pole 80 at their positions corresponding to the openings 85 of the projected portion 82*a* and the slots 86 of the projected portion 82*b*. Then, the openings 85 and the through-holes 88' are made coincident, and the openings 86 and the through-holes 89' are made coincident through which bolts 90 and 91 are inserted and then fastened by nuts 92, 93, thus mounting the movable pedestal 82 on the pole 80. When the movable pedestal 82 is moved under the condition that the nuts 92, 93 are unlocked, the movable pedestal 82 can be rotated around the bolt 90 within a range of the slots 86, thus the angle of elevation of the antenna can be coarsely adjusted.

The pole 80 has a through-hole 94 bored therethrough at the position between its supporting members 88 and 89. Also, the pole 80 has a nut 95 fixed thereto by welding or the like at its one side opposite to the through-hole 94. An elevation-angle fine adjusting bolt 96 is inserted into the nut 95 from above through the through-hole 94 and engaged with the nut 95. When the bolt 96 is being screwed into the nut 95, the top of the bolt 96 comes in contact with the movable pedestal 82. When the bolt 96 is screwed further, under the condition that the nuts 92, 93 are loosed, the movable pedestal 82 is moved away from the pole 80 against the pressure of the bolt 96. Thus, it becomes possible to fine adjust the elevation-angle of the antenna. That is, only by the single bolt 96, the elevation-angle of the antenna can be fine adjusted in a range of a predetermined angle, for example 16°.

The pole 80 is curved or inclined near at least its antenna mounting portion, for example, near the supporting member 89 by a predetermined angle, e.g., 20°. Accordingly, the movable pedestal 82 does not have to be rotated much in order to obtain a predetermined elevation-angle of the antenna and also, the slots 86 may be short, thus making it possible to make the metal fittings of the movable pedestal 82 small in size.

A cover 97 is attached to the movable pedestal 82 so as to cover the top portion of the pole 80. The cover 97 has a cut-away portion 97*a* formed therethrough at its under side to pass the pole 80 therethrough and engaging portions 97*b* formed at both sides of the cut-away portion 97*a* to be engaged with a converter casing 102.

The rear cover 48 has a pair of bosses 98 and bosses of a predetermined number, for example, 4 bosses 99 formed on its rear wall. A converter 100 is secured to the pair of bosses 9B by screws not shown. A packing 101 is provided around the converter 100 and then the converter housing 102 is mounted to the bosses 99 by screws not shown. At that time, the top portion of the converter housing 102 is engaged with the engaging portions 97*b* of the cover 97.

FIG. 15 shows the overall construction of the thus assembled antenna apparatus of the present invention as viewed from its rear side. The main body of antenna is deviated from the vertical direction by a predetermined angle, for example, 10°. Further, since the pole 80 is curved as described above, the main body of antenna and the pole 80 are deviated from each other by 20°. Thus, in this case, by using the elevation-angle fine adjusting bolt 96, it is possible to vary the elevation-angle of the antenna in a range of 30° to 46°. It is needless to say that this elevation-angle of the antenna can be determined freely in response to the receiving condition for radio waves at respective areas.

FIG. 16 shows how the elevation-angle of the antenna is varied by the elevation-angle fine adjusting bolt 96. In FIG. 16, the solid line shows the condition that the bolt 96 is loosed fully and the two-dot chain line shows the condition that the bolt 96 is screwed fully.

The process for adjusting the elevation-angle and the azimuth angle of the antenna will be described below.

First, the pole 80 is temporarily secured, the nuts 92, 93 are lossenly fixed and the movable pedestal 82 is coarse moved so as to select the elevation-angle of the antenna near the angle corresponding to that of the area, toward a satellite in geosynchronous orbit, for example, about 38° in Tokyo, Japan, and about 31° in Sapporo, Japan. Then, by adjusting the elevation-angle fine adjusting bolt 96, the elevation-angle of the antenna can be set to the value corresponding to that of the area substantially precisely. Then, the pole 80 is rotated to direct the antenna in the south west (in the case of Japan), thus coarse adjusting the azimuth angle of the antenna. Then, a desired radio wave is received and the bolt 96 is again adjusted to finally decide the elevation-angle of the antenna. Thereafter, fastening the nuts 92, 93, the movable pedestal 82 is secured to the pole 80. Again, the pole 80 is slightly rotated to finally determine the azimuth angle of the antenna and the pole 80 is fixed. Thus, the predetermined radio waves can be received positively.

FIG. 17 illustrates an example of how to install the pole 80. In this example, the pole 80 is installed on a fence 106 of, for example, a veranda facing the south by using fixing plates 107. U-shaped bolts 108 and nuts 109. It is needless to say that the installing method of the pole 80 is not limited to the above-mentioned method.

According to the example shown in FIG. 14, since the pole serving as the mounting pedestal is used to form the main body of the antenna and the pole as one body, the number of assembly parts of the antenna mounting structure can be reduced and the construction thereof can be made small. Further, since the fine adjusting mechanism is made of only one bolt, the number of assembly parts thereof can be reduced and the adjustment can be performed with ease. In addition, since the pole is curved or inclined at its intermediate position, the space occupied by the elevation-angle adjusting mechanism itself can be reduced.

FIG. 18 shows another example of the present invention in which between the bottom plate 1 and the substrate 3 and between the substrate 3 and the top plate 2, there are respectively located spacers 110 and 111 for supporting the substrate 3 and making the spacings between the substrate 3 and the bottom and top plates 1, 2 uniform. Each of the spacers 110, 111 may be made of a high foaming dielectric material such as polyethylene, polypropylene, polystyrol or the like of low relative dielectrio constant and low transmission loss.

FIG. 19 is a cross-sectional view of an example in which the spacer 110 is sandwiched between the bottom plate 1 and the substrate 3 and the spacer 111 is sandwiched between the substrate 3 and the top plate 2. According to this construction, the substrate 3 can be positively held between the top and bottom plates 2 and 1 with a uniform spacing therebetween so that the substrate 3 can be prevented from being partly displaced in the up and down direction.

In order to minimize the dielectric loss, the spacers 110 and 111 have openings 112, 113 bored therethrough at their portions corresponding to the radiation elements, i.e., printed elements 8.

FIG. 20 shows in detail a construction of the spacer 110 which is typically represented from the spacers 110 and 111. The spacer 111 is formed exactly the same as the spacer 110.

Referring to FIG. 20, there are shown an opening 114 which allows the input wave-guide 40 (see FIG. 8B) communicated to the converter 44 to pass therethrough, openings 114 for positioning the openings 116 which allow the bosses 71 (see FIG. 13A) for securing the entire construction to pass therethrough. An opening 117 passes each of the protrusions 30 (see FIG. 19). Regardless of the existence of the protrusions 30, the openings 117 are formed through the whole portion of the spacer 110 in order to improve the mass-production efficiency of the spacer 110. In practice, about 30% of these openings 117 are used to pass the protrusions 30.

In the example of FIG. 19, since the spacers with a number of corresponding openings are provided between the top plate and the substrate and between the substrate and the bottom plate to support the substrate, the substrate can be positively supported at the intermediate position between the top and bottom plates with a uniform spacing therebetween as compared with the example of FIG. 2. Thus, it is possible to avoid deterioration in the antenna characteristic by positional displacement of the substrate in the up and down direction. In addition, since the number of the protrusions 30, 31 projected from the top and bottom plates can be considerably reduced, the plates can be produced with ease and the mass-production efficiency can be improved.

It should be understood that the above description is presented by way of example on the preferred embodiments of the present invention and it will be apparent that many modifications and variations thereof could be effected by one with ordinary skill in the art without departing from the spirit and scope of the novel concepts of the invention so that the scope of the invention should be determined only by the appended claims.

It is claimed:

1. A suspended line feed type planar antenna comprising a substrate sandwiched between a top plate and a bottom plate, said top plate having a plurality of spaced openings defining radiation elements, a corresponding plurality of radiators formed on said substrate in alignment with said openings, respectively, and feeding means for feeding said radiators, a first portion of said top and bottom plates being each formed of a flat plate with substantially no protrusions and a second portion of said top and bottom plates having protrusions deformed by press-treatment at corresponding locations on said top and bottom plates at a plurality of positions, by deforming small areas of said top and bottom plates, said protrusions extending between said top plate and said substrate and between said bottom plate and said substrate, said substrate being supported by said protrusions, and said protrusions occupying a minor proportion of the surface area of said top and bottom plates.

2. An antenna according to claim 1, wherein said feeding means comprises an input wave-guide, an output wave-guide, and supporting means having a bolt which passes through said top and bottom plates and said substrate for supporting said input and output wave-guides.

3. An antenna according to claim 1, further comprising a radome and a rear cover for enclosing said top and bottom plates, a plurality of supporting members formed on the inner surface of said rear cover and a corresponding plurality of openings formed in said top and bottom plates and said substrate at positions corresponding to said supporting members, said top and bottom plates and said substrate being supported by said supporting members extending through said corresponding plurality of openings.

4. An antenna according to claim 3, wherein said plurality of supporting members are protrusions integrally molded with said rear cover, and said antenna further comprises plate holders and bolts for holding said top and bottom plates and said substrate at the positions of said protrusions.

5. An antenna according to claim 1, further comprising a radome and a rear cover for enclosing said top and bottom plates, a pole having a top portion inclined from a vertical line, a first through-hole provided at the upper side of said inclined top portion and a second through-hole provided at the lower side of said inclined top portion, mounting means including a first bolt passing through said first through-hole for mounting said rear cover on said pole, and adjusting means including a second bolt passing through said second through-hole for adjusting the elevation-angle of said rear cover.

6. An antenna according to claim 1, further comprising a first spacer having a corresponding plurality of spaced openings inserted between said top plate and said substrate, and a second spacer having a corresponding plurality of spaced openings inserted between said substrate and said bottom plate.

7. A suspended line feed type planar antenna comprising a substrate sandwiched between a top plate and a bottom plate, said top plate having a plurality of spaced openings defining radiation elements, a corresponding plurality of radiators formed on said substrate in alignment with said openings, respectively, and feeding means for feeding said radiators, said feeding means comprising an input wave-guide, an output wave-guide, and supporting means having a bolt which passes through said top and bottom plates and said substrate for supporting said input and output wave-guides.

8. A suspended line feed type planar antenna comprising a substrate sandwiched between a top plate and a bottom plate, said top plate having a plurality of spaced openings defining radiation elements, a corresponding plurality of radiators formed on said substrate in alignment with said openings, respectively, feeding means for feeding said radiators, and a radome and a rear cover for enclosing said top and bottom plates, said rear cover having a plurality of supporting members formed on its inner surface, and a corresponding plurality of openings being formed through said top and bottom plates and said substrate at the corresponding positions of said supporting members, said top and bottom plates and said substrate being supported by said supporting members by means of said corresponding plurality of openings.

9. An antenna according to claim 8, wherein said plurality of supporting members comprise protrusions integrally molded with said rear cover, and including plate holders and bolts for holding said top and bottom plates and said substrate at the positions of said protrusions.

10. A suspended line feed type planar array antenna comprising a substrate sandwiched between a top plate and a bottom plate, a rear cover enclosing said top and bottom plates, said top plate having a plurality of spaced openings defining radiation elements, a corresponding plurality of radiators formed on said substrate in alignment with said openings respectively, feeding means for feeding said radiators, and supporting means comprising a pole having a top portion inclined to a vertical line, a first through-hole provided at the lower side of said inclined top portion, mounting means including a first bolt passing through said first through-hole for mounting said rear cover on said pole and adjusting means including a second through-hole and a second bolt passing through said second through-hole for adjusting the elevation-angle of said rear cover.

11. An antenna according to claim 10, wherein said pole has a third through-hole substantially perpendicular to said first and second through-holes and fine adjusting means including a third bolt passing through said third through-hole for fine adjusting the elevation-angle of said rear cover.

12. A suspended line feed type planar antenna comprising a substrate sandwiched between a top plate and a bottom plate, said top plate having a plurality of spaced openings defining radiation elements, a corresponding plurality of radiators formed on said substrate in alignment with said openings, respectively, feeding means for feeding said radiators, a first dielectric spacer sheet having a corresponding plurality of spaced openings inserted between said top plate and said substrate, and a second spacer having a corresponding plurality of spaced openings inserted between said substrate and said bottom plate.

13. An antenna according to claim 12, wherein said first and second spacers are plastic sheets, respectively.

* * * * *